US011573533B2

(12) United States Patent
Le Moal et al.

(10) Patent No.: US 11,573,533 B2
(45) Date of Patent: Feb. 7, 2023

(54) ORGAN FOR ELASTICALLY HOLDING A TIMEPIECE COMPONENT ON A SUPPORT ELEMENT

(71) Applicant: Nivarox-FAR S.A., Le Locle (CH)

(72) Inventors: Romain Le Moal, Villers-le-Lac (FR); Frederic Vaucher, La Chaux-de-Fonds (CH); Pierre Cusin, Villars-Burquin (CH)

(73) Assignee: Nivarox-FAR S.A., Le Locle (CH)

( * ) Notice: Subject to any disclaimer, the term of this patent is extended or adjusted under 35 U.S.C. 154(b) by 279 days.

(21) Appl. No.: 16/904,655

(22) Filed: Jun. 18, 2020

(65) Prior Publication Data

US 2021/0048781 A1 Feb. 18, 2021

(30) Foreign Application Priority Data

Aug. 16, 2019 (EP) ..... 19192159

(51) Int. Cl.
*G04B 17/32* (2006.01)

(52) U.S. Cl.
CPC ..... *G04B 17/32* (2013.01)

(58) Field of Classification Search
CPC ..... G04B 13/021; G04B 17/32; G04B 15/14; G04B 15/08; G04B 13/026; G04B 13/022; G04B 17/345
See application file for complete search history.

(56) References Cited

U.S. PATENT DOCUMENTS 2,995,019 A 8/1961 Stamm
8,882,341 B2 * 11/2014 Chu ..... G04B 17/345 368/177
9,250,610 B2 2/2016 Daout
10,579,020 B2 * 3/2020 Di Domenico ..... G04B 17/32
10,747,177 B2 * 8/2020 Shibuya ..... G04B 15/14
10,761,483 B2 * 9/2020 Shibuya ..... G04B 13/022
2009/0154303 A1 6/2009 Vaucher et al.
2012/0199996 A1 8/2012 Cusin et al.
2014/0313869 A1 10/2014 Cattiau
2017/0176935 A1 6/2017 Dubois et al.
2019/0076876 A1 3/2019 Shibuya et al.

FOREIGN PATENT DOCUMENTS

CN 102004431 A 4/2011
CN 103869677 A 6/2014
CN 104122781 A 10/2014
CN 106264646 A 1/2017
CN 107193198 A 9/2017
(Continued)

OTHER PUBLICATIONS

Office Action dated May 14, 2021 in corresponding Indian Patent Application No. 202044034810 (with English Translation). 5 pages.
(Continued)

*Primary Examiner* — Edwin A. Leon

(74) *Attorney, Agent, or Firm* — Oblon, McClelland, Maier & Neustadt, L.L.P.

(57) ABSTRACT

An elastic holding organ for fastening a timepiece component on a support element, including a rigid portion provided with an inner face including at least three deformable arms provided with free ends defining an opening into which the support element can be inserted, the arms being configured to perform a coupling with the support element by an elastic clamping in compression of this support element in the opening.

15 Claims, 2 Drawing Sheets

(56) References Cited

FOREIGN PATENT DOCUMENTS

| | | | |
|---|---|---|---|
| CN | 109718419 | A | 5/2019 |
| EP | 1 705 533 | A1 | 9/2006 |
| EP | 2 372 473 | A2 | 10/2011 |
| EP | 3 182 211 | A1 | 6/2017 |
| EP | 3 462 249 | A1 | 4/2019 |
| JP | 52-8464 | U | 1/1977 |
| JP | 2009-528524 | A | 8/2009 |
| JP | 2019-52931 | A | 4/2019 |
| WO | WO 2015/067419 | A1 | 5/2015 |

OTHER PUBLICATIONS

Combined Chinese Office Action and Search Report dated Feb. 15, 2022 in Patent Application No. 202010818622.0 (with English translation of Category of Cited Documents), 8 pages.
Combined Chinese Office Action and Search Report dated Jun. 18, 2021 in Chinese Patent Application No. 202010818622.0 (with English translation of Categories of Cited Documents), 7 pages.
Japanese Office Action dated Jul. 6, 2021 in Japanese Patent Application No. 2020-109325 (with English translation), 7 pages.
Russian Federation Office Action dated Jun. 29, 2021 in Russian Federation Patent Application No. 2020122431/28(038550) (with English translation), 11 pages.
Combined Russian Office Action and Search Report dated Dec. 15, 2020 in Russian Patent Application No. 2020122431 (with English translation), 12 pages.
European Search Report dated Feb. 25, 2020 in European Application 19192159.2 filed on Aug. 16, 2019 (with English Translation of Categories of Cited Documents), 4 pages.

* cited by examiner

ORGAN FOR ELASTICALLY HOLDING A TIMEPIECE COMPONENT ON A SUPPORT ELEMENT

CROSS-REFERENCE TO RELATED APPLICATION

This application claims priority to European Patent Application No. 19192159.2 filed on Aug. 16, 2019, the entire disclosure of which is hereby incorporated herein by reference.

TECHNICAL FIELD

The invention relates to an organ for elastically holding a timepiece component on a support element.

The invention also relates to an elastic holding organ-timepiece component set and an assembly comprising such a set and this support element.

The invention finally relates to a horological movement comprising this assembly as well as to a timepiece comprising such a movement.

TECHNOLOGICAL BACKGROUND

In the state of the art, elastic holding organs are known, such as clockwork collets, generally made of materials called fragile materials such as silicon which contribute in assembling balance-springs on shafts of regulating organ balance such as horological movement resonators, by a coupling of the elastic clamping type made from a coupling system comprising deformable arms such as elastic blades which are conventionally stressed in bending.

However, one of the major disadvantages of these holding organs is related to the fact that the coupling system that they implement allows obtaining only a small elastic clamping force in the given dimensions because the breakage limit stress of the material constituting these holding organs is often reached quickly.

The purpose of the invention is to provide an alternative to the existing holding organs.

SUMMARY OF THE INVENTION

In this purpose, the invention relates to an elastic holding organ for fastening a timepiece component on a support element, including a rigid portion comprising an inner face comprising at least three deformable arms provided with free ends defining an opening into which said support element can be inserted, the arms being configured to perform a coupling with the support element by an elastic clamping in compression of this support element in the opening.

Thus, such features contribute in obtaining a holding organ capable of performing a coupling by elastic clamping in compression which is high, without exceeding the breakage limit stress of the material constituting this holding organ.

In other embodiments:

- each deformable arm consists essentially of a main part including a material volume which regularly decreases from a direction from this inner face towards a central axis of said organ;
- rigid portion comprises a material volume which is greater than the sum of the material volumes of the deformable arms 4 of this holding organ;
- each arm has an essentially trapezoidal shape;

- the inner face defines a volume in said organ partially occupied by the deformable arms;
- the organ comprises six deformable arms;
- the organ is made of a fragile material, in particular a micromachinable material;
- the organ is a collet;

The invention also relates to an elastic holding organ-timepiece component set for a horological movement of a timepiece comprising such a holding organ.

The invention also relates to an assembly for a horological movement of a timepiece comprising an elastic holding organ-timepiece component set and a support element, said set being coupled by an elastic clamping in compression with the support element.

The invention also relates to a horological movement comprising at least one such assembly.

The invention also relates to a timepiece comprising such a horological movement.

BRIEF DESCRIPTION OF THE FIGURES

The invention will be described below in more detail using the appended drawings, given by way of non-limiting examples, wherein.

DETAILED DESCRIPTION OF THE INVENTION

Figure 1:
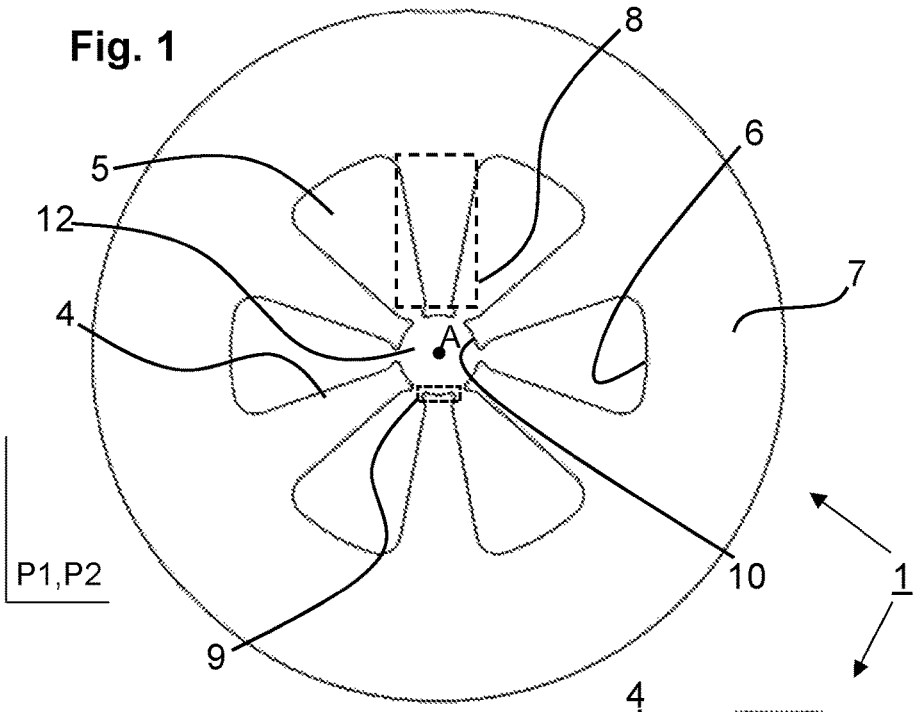
FIG. 1 shows a sectional view of a first variant of the holding organ in a rest configuration, according to an embodiment of the invention.
Figure 2:
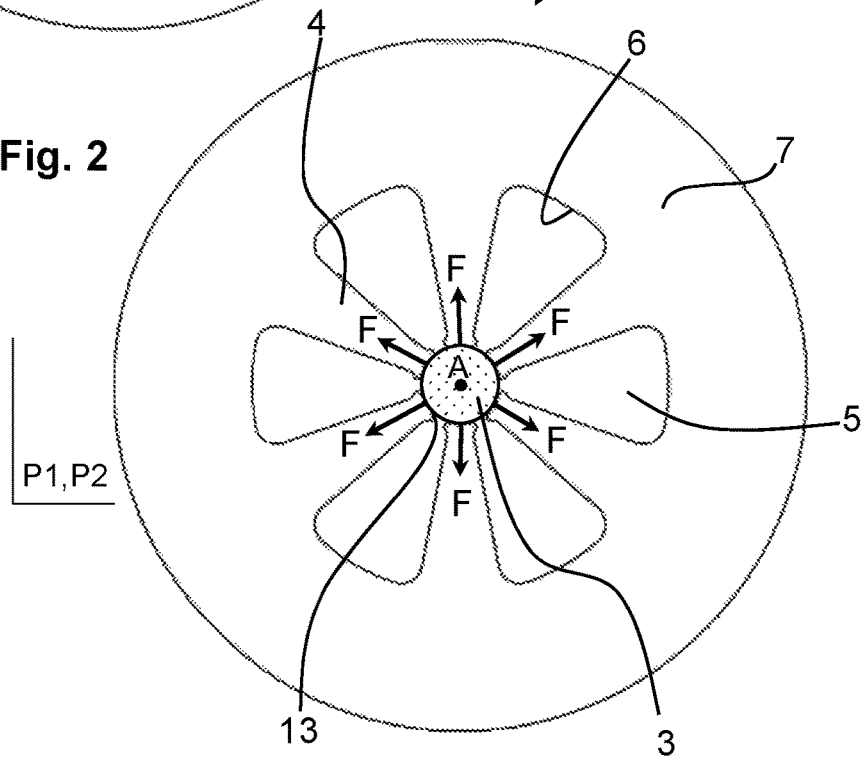
FIG. 2 shows a sectional view of the first variant of the holding organ in a stress configuration, mounted on a support element, according to the embodiment of the invention.
Figure 3:
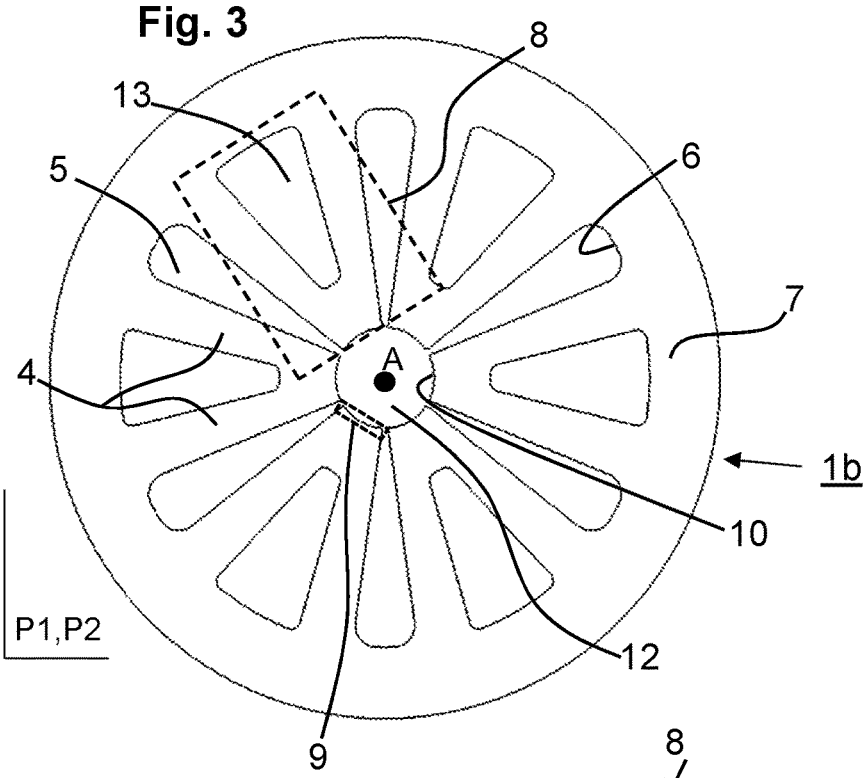
FIG. 3 shows a sectional view of a second variant of the holding organ in a rest configuration, according to the embodiment of the invention.
Figure 4:
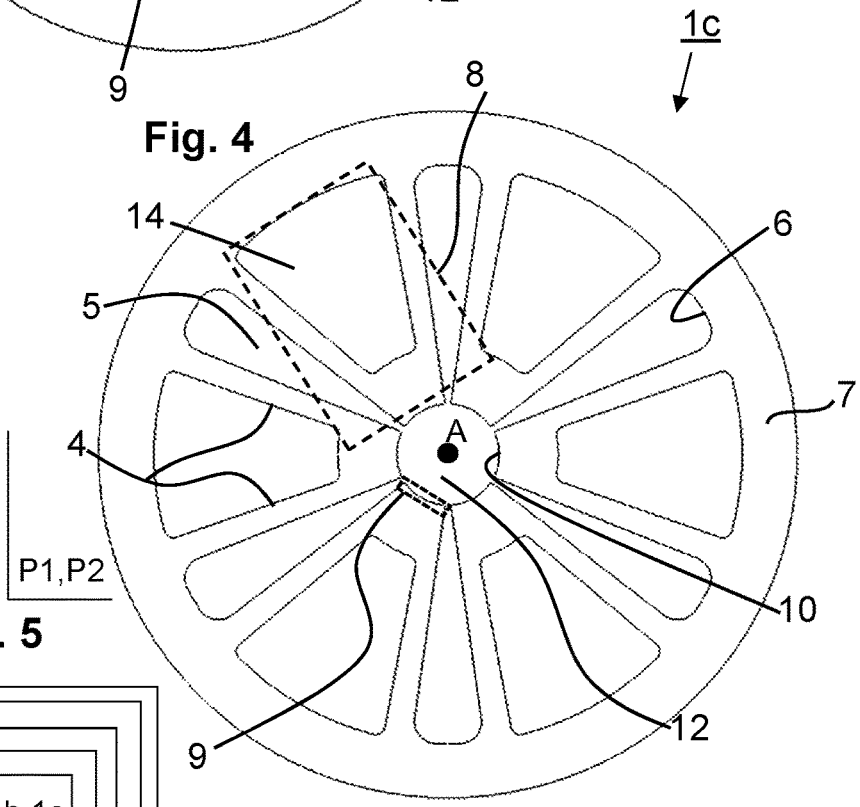
FIG. 4 shows a sectional view of a third variant of the holding organ in a rest configuration, according to the embodiment of the invention.
Figure 5:
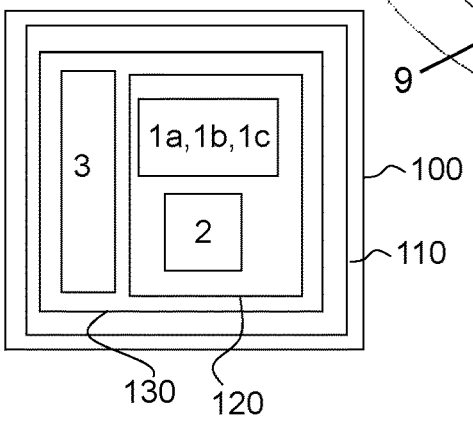
FIG. 5 is a schematic view of a timepiece comprising the assembly including the elastic holding organ-timepiece component set coupled to the support element, according to the embodiment of the invention.

FIGS. 1 to 5 show different variants of the elastic holding organ 1*a*, 1*b*, 1*c* for fastening a timepiece component 2 on a support element 3. For example, the elastic holding organ 1*a*, 1*b*, 1*c* can be a ring or else a collet or any piece capable of ensuring the fastening of the timepiece component 2 such as a balance-spring or else a wheel, to a support element 3 such as a shaft. This elastic holding organ 1*a*, 1*b*, 1*c* is made of a material called "fragile" material, preferably a micromachinable material. Such a material can comprise silicon, quartz, corundum, silicon and silicon dioxide, DLC, metallic glass, ceramic, other at least partially amorphous material, or the like.

In this embodiment, this holding organ 1*a*, 1*b*, 1*c* can be comprised in an elastic holding organ-timepiece component set 120. Such a set 120 is provided to be arranged in a horological movement 110 of a timepiece 100 visible in FIG. 3, and also intended to be mounted on a support element 3. Such a set 120 may be made in one piece and be made of a "fragile" material similar to that of the holding organ 1. It will be noted that in a variant of this set 120, only the elastic holding organ 1*a*, 1 *b*, 1*c* can be made of such a material called "fragile" material, the timepiece component 2 then being made of another material.

This set 120 may be part of an assembly 130 for the horological movement 110. Here, such an assembly 130 has been conceived for applications in the watchmaking field. However, this assembly 130 can perfectly be implemented in other fields such as aeronautics, jewellery, or else the automobile.

Such a holding organ 1*a*, 1*b*, 1*c* is preferably made in one piece which comprises a preferably planar upper face and lower face, which are both comprised respectively in first and second planes P1 and P2. This organ 1*a*, 1*b*, 1*c* also has a thickness which extends from the upper face to the lower face. Such a holding organ 1*a*, 1*b*, 1*c* also comprises a rigid portion 7 provided with an inner face 6. This rigid portion 7 corresponds to the part of the holding organ 1*a*, 1*b*, 1*c* which comprises the most significant material volume/amount. In other words, the rigid portion 7 comprises a material volume/amount which is greater than the material volume/amount of the set of deformable arms 4 of the holding organ 1*a*, 1*b*, 1*c*. It is therefore understood that the rigid portion 7 includes a material volume which is greater than the sum of the material volumes of the deformable arms 4 of this holding organ 1*a*, 1*b*, 1*c*. The holding organ 1*a*, 1*b*, 1*c* may also comprise an outer face or outer peripheral wall, in particular when it is a collet which is in particular intended to be connected to the timepiece component 2 via at least one attachment point arranged in this outer face. In a variant, such an outer face, and therefore the holding organ 1, may be made integrally with the timepiece component 2 when the latter is a wheel visible in FIGS. 1 and 2.

In this holding organ 1*a*, 1*b*, 1*c*, the inner face 6 contributes in defining a volume 5 wherein at least three deformable arms 4 provided with free ends 9 are arranged. In the present embodiment, this organ 1*a*, 1*b*, 1*c* comprises six arms 4 shown in FIGS. 1 and 2. It will be noted that this volume 5 is only partially occupied by these deformable arms 4. Such arms 4 are comprised in the inner face 6 and extend radially from this face 6 to a central axis A of said holding organ 1*a*, 1*b*, 1*c*. In the first variant illustrated in FIGS. 1 and 2, these deformable arms 4 essentially consist of a main full/non-openworked part 8, including a material volume/amount which decreases regularly in a direction extending from this inner face 6 to the central axis A. In the second and third variants visible in FIGS. 3 and 4, the deformable arms 4 essentially consist of a main openworked part 8, with a greater openwork 14 in the third variant than that 13 of the second variant. In these second and third variants, the material volume/amount also decreases regularly in a direction extending from this inner face 6 to the central axis A. In addition, it is therefore understood that the material volume/amount in the main part 8 of each arm 4 of the third variant is less than in that of each arm 4 of the second and even less than in that of each arm 4 of the first variant.

It will be noted that each of these arms 4 preferably has an essentially trapezoidal or else "V" shape. In other words, each arm 4 has a flared shape extending from the free end 9 to the inner face 6.

These deformable arms 4 each comprise two ends, a first end connected to the inner face 6 of the holding organ 1*a*, 1*b*, 1*c* and a second end which is the free end 9 visible in FIG. 1. This free end 9 comprises a contact face 10 having a shape configured/adapted to cooperate with a mounting area of the support element 3 intended to cooperate with this contact face 10. By way of example in these variants, when this mounting area is defined on a cylindrical shaped part of the support element 3 then the contact face 10 has a compatible shape capable of matching this cylindrical shape by being for example a curved contact face 10. The free ends 9 of these arms 4 together define an opening 12 into which said support element 3 can be inserted. This opening 12 defines a volume in the holding organ 1*a*, 1*b*, 1*c* which is lower than that of the mounting area comprised in one end of the support element 3 which is provided to be arranged therein.

In this context, the mounting area of the support element 3 comprises all or part of the contact portions 13 of this support element 3 with the holding organ 1*a*, 1*b*, 1*c* which are defined on a peripheral wall of this support element 3 and which are provided in particular to cooperate with the arms 4 of this holding organ 1*a*, 1*b*, 1*c*. It will be noted that this support element 3 comprises at least as many portions 10 as the holding organ 1*a*, 1 *b*, 1*c* comprises arms 4.

In this holding organ 1, each arm 4 is capable of being deformed in compression, that is to say radially relative to the central axis A of the holding organ which is coincident with that of the axis of the opening 5. In other words, each of these arms 4 when it is subjected to a stress induced by the support element 3 as will be seen later, is capable of being deformed when switching from a rest configuration to a stressed configuration. In this context, when switching from this rest configuration to the stressed configuration, all or part of this arm 4 is then radially compressed relative to the central axis A to the inner face 6 of the holding organ 1. Such arms 4 exert a force against the support element, thus allowing to ensure an elastic clamping coupling of the support element 3 in the opening 12 while being configured to be radially compressed/deformed relative to the central axis A of said opening 5.

It will be noted that the disposition of the deformable arms 4 in the holding organ 1*a*, 1 *b*, 1*c* allows, during insertion with clamping, a deformation of each arm 4 allowing to accommodate the deformation of the holding organ 1*a*, 1*b*, 1*c* with the geometry of the mounting area of the support element 3.

Thus, during the mounting of this holding organ 1*a*, 1*b*, 1*c* on the support element 3, one end of this support element 3 comprising the mounting area is then inserted into the opening 12 defined in the holding organ 1. In this context, this mounting area which comprises the contact portions 13 of this support element 3, is preferably arranged coaxially with the opening 12, around the central axis A which is common to this mounting area and to this opening 12 of the holding organ 1. Such an arrangement around this common axis A contributes in indexing this mounting area relative to the opening 12 during this insertion. More specifically, during this insertion, the contact faces 10 undergo a radial deformation therefore the arms 4 then undergo an elastic deformation under the effect of the application on the contact faces 10 of the arms 4 by the contact portions 13 of the mounting area of the support element 3, of a compressive force F illustrated in FIG. 2. Such a compressive force F generates an elastic deformation in compression of each arm 4 in a radial direction relative to the central axis A, to the first end of the arm 4 connected to the inner face 6 of the holding organ 1*a*, 1*b*, 1*c*. Such a deformation contributes in particular in that the holding organ 1*a*, 1*b*, 1*c* stores a large amount of elastic energy which contributes to giving it a substantial holding torque, in particular allowing optimum holding by elastic clamping in compression. In addition, it will be noted that such an elastic organ 1*a*, 1 *b*, 1*c* allows considerably increasing the clamping force in comparison with the elastic organs of the state of the art, indeed this clamping force is here approximately twice as large as that of the organs of the state of the art for the same configuration.

The invention claimed is:

1. An elastic holding organ for fastening a timepiece component on a support element, comprising:

a rigid portion comprising an inner face comprising at least three deformable arms provided with free ends defining an opening into which said support element can be inserted, the arms being configured to perform a coupling with the support element by an elastic clamping in compression of said support element in the opening, wherein each deformable arm comprises a main part comprising a material volume which regularly decreases from a direction from said inner face towards a central axis of said organ.

2. The organ according to claim 1, wherein the rigid portion comprises a material volume which is greater than the sum of the material volumes of the deformable arms of said holding organ.

3. The organ according to claim 1, wherein each arm has an essentially trapezoidal shape.

4. The organ according to claim 1, wherein the inner face defines a volume in said organ partially occupied by the deformable arms.

5. The organ according to claim 1, comprising six deformable arms.

6. The organ according to claim 1, wherein the organ is made of a fragile material.

7. The organ according to claim 1, wherein the organ is a collet.

8. A set for a horological movement of a timepiece comprising:

the organ according to claim 1, and the timepiece component.

9. An assembly comprising:

the set according to claim 8, and a support element, said set being coupled by an elastic clamping in compression with the support element.

10. The horological movement comprising at least one of the assembly according to claim 9.

11. The timepiece comprising the horological movement according to claim 10.

12. The organ according to claim 1, wherein two of the arms join at the free end to form a common contact face.

13. The organ according to claim 12, wherein an internal opening is positioned between the two of the arms that join at the free end to form the common contact face, and the internal opening does not extend to the opening.

14. The organ according to claim 1, wherein the organ is made of a micromachinable material.

15. The organ according to claim 1, wherein the organ comprises silicon, quartz, corundum, silicon and silicon dioxide, metallic glass, ceramic, or an at least partially amorphous material.

* * * * *